United States Patent [19]

Costanza

[11] 4,004,493

[45] Jan. 25, 1977

[54] BULLET PROOF GARMENT

[76] Inventor: Vincent Costanza, P. O. Box 294, Norristown, Pa. 19404

[22] Filed: Nov. 26, 1974

[21] Appl. No.: 517,381

[52] U.S. Cl. ..... 89/36 A; 2/2.5; 245/9

[51] Int. Cl.[2] ..... F41H 1/02

[58] Field of Search ..... 2/2.5; 59/91; 245/4, 245/9; 89/36 A, 36 D; 109/49.5, 79; 160/220, 332, 350

[56] References Cited

UNITED STATES PATENTS

| | | | |
|---|---|---|---|
| 642,649 | 2/1900 | Vaughan | 2/2.5 |
| 1,021,804 | 4/1912 | Schneider | 2/2.5 |
| 1,479,402 | 1/1924 | Soltesz | 245/4 |
| 1,728,867 | 9/1929 | Nicoletti | 245/9 |

*Primary Examiner*—Stephen C. Bentley

*Attorney, Agent, or Firm*—Caesar, Rivise, Bernstein & Cohen

[57] ABSTRACT

An improved design in bullet proof garments consisting of an armored layer between a nylon fabric inner layer and an outside cushion layer of material, the armored layer consisting of an assembly of small metal plates bent either into U-shaped or N-shaped configuration and fastened together by small rings so to form a flexible panel that allows a wearer to comfortably move his body while the metal plates resist a bullet penetration due to a novel design in which springness thereof is used to resist the bullet.

4 Claims, 8 Drawing Figures

Fig. 1
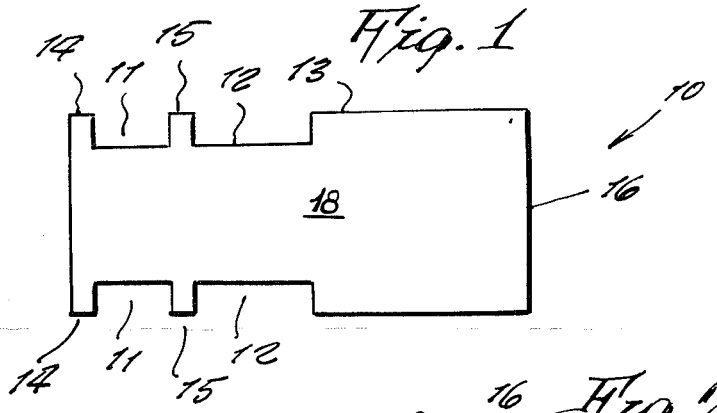
Fig. 2
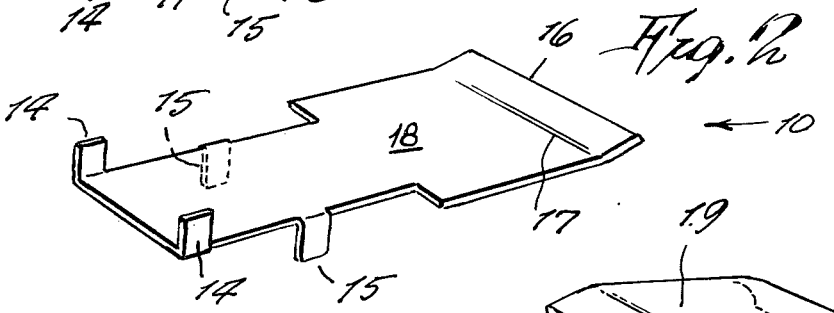
Fig. 3
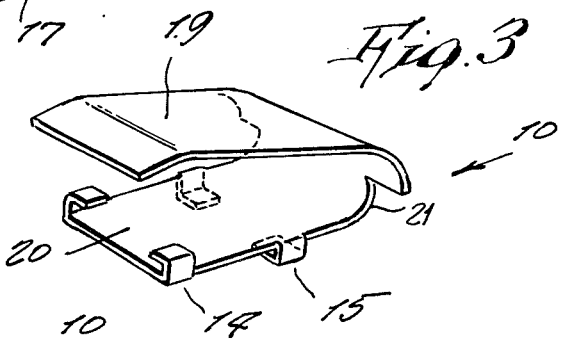
Fig. 4
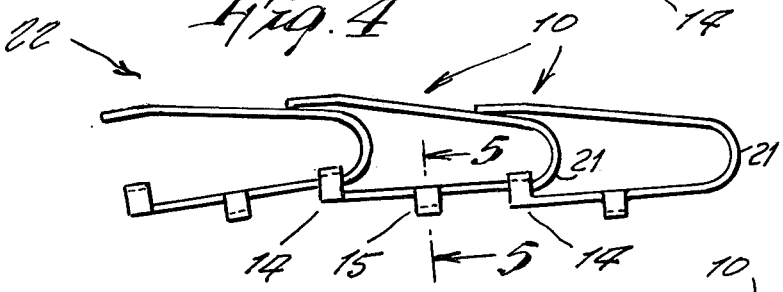
Fig. 5
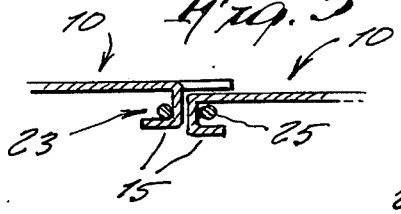
Fig. 8
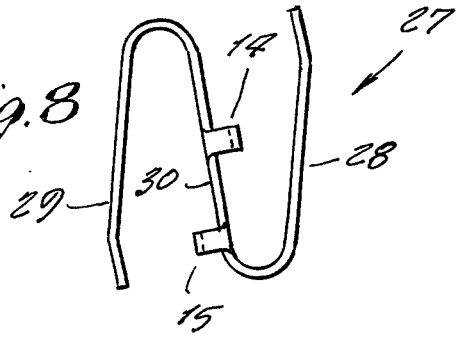
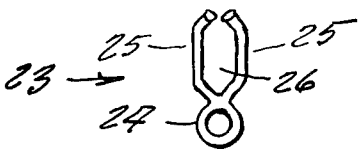
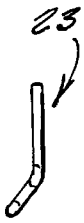
Fig. 6 Fig. 7

BULLET PROOF GARMENT

This invention relates generally to bullet proof garments.

A principal object of the present invention is to provide a bullet proof garment new design in which there is an armored layer comprised of small metal plates that are bent into a U-shape or N-shape so that an outer side thereof has a spring function that receives a violent impact of a bullet, absorbs the shock and repels the bullet penetration.

Another object of the present invention is to provide a bullet proof new design in which the metal plates are flexibly connected together by rings so that the armored layer can flex in any direction in order to allow a wearer to be comfortable in moving his body.

Still, another object of the present invention is to provide a bullet proof garment new design in which the armored layer is enclosed between a first layer of inner nylon fabric and an inside and outside second layer of one hundred percent cushion laminated type nylon.

Still another purpose of the present invention is to provide a bullet proof garment new design in which a third layer may be finished in any desired fabric or color and the garment may be made in any form such as a jacket, vest or other cumberbund type garment.

Other objects of the invention are to provide a bullet proof garment new design which is simple in design, inexpensive to manufacture, rugged in construction, easy to use and efficient in operation.

These and other objects will be readily evident upon a study of the following specification and the accompanying drawing, wherein:

FIG. 1 is a side perspective of one of the elements that comprise the armored layer of the bullet proof garment.

FIG. 2 is a perspective view thereof shown partly bent up.

FIG. 3 is a similar view thereof shown fully formed in shape.

FIG. 4 is a side view of a series of elements connected together so to form the bullet proof garment armored layer.

FIG. 5 is an enlarged cross sectional view taken on line 5—5 of FIG. 4, showing how the elements alongside each other are connected together by a wire clip or ring.

FIG. 6 is a plan view of the clip.

FIG. 7 is a side view of the clip.

FIG. 8 is a side view of a modified design of the armored layer element bent up into an N-shape.

Referring now to the drawing in detail, the reference numeral 10 shows in FIGS. 1 through 5 an armored layer element which is made from a high quality steel material which is approximately three sixty fourths of an inch thick and which measures one and one half inches long. This element shown in a flat pattern in FIG. 1 is generally rectangular and having notches 11 and 12 along each longitudinal side 13 in order to form opposite extending side tongues 14 and 15. As shown in FIG. 2, the tongues 14 are upwardly bent at a right angle whereas the tongues 15 are downwardly bent at a right angle and one end edge 16 is slightly upwardly bent around a transverse bend 17. As further shown in FIG. 2, each of the tongues 14 and 15 are then additionally bent at their terminal portions an additional ninety degrees so that the terminal ends thereof face each other so to form hooks. Additionally the main body 18 of the element 10 is transversely bent over about a transverse bend at approximately the center thereof so that the element now assumes a generally U-shaped configuration as shown in FIG. 3 thus forming an outside panel 19 and an inside panel 20 with the bend 21 at one end thereof.

The element 10 thus formed are then joined together in longitudinal rows 22 as shown in FIG. 4 wherein the joinder is accomplished by means of tongues 14 of one element grasping another like element therebetween as shown. Parallel rows 22 thus formed are then joined together to form a wide layer by means of the tongues 15 of one row 22 being connected to like tongues 15 of an adjacent row 22 by means of wire clips 23.

As shown in FIGS. 6 and 7, each of the clips 23 is made of a metal wire and includes a central ring 24 which is at a lightly inclined angle respective to two terminal legs 25 which at their very ends are bent towards each other so that together they form an open loop 26 for being snapped around the two tongues 15 of elements 10 in two different rows 22.

The small ring 24 of the clip 23 is inclined so to permit sewing thereto a first layer of nylon fabric which forms an inner portion of the garment. An outer layer of the garment nylon is glued to the metal. The armored layer of this invention can be used in any of the garments known to the art, such as those shown in U. S. Pat. Nos. 642,649, 1,021,804 and 3,577,836.

After construction of the garment, it is to be noted that the panel 19 of the elements forms the outer side of the armored layer and against which bullets would impact. Due to the U-shaped configuration of the elements, the panel 19 thus is springingly flexible respective to the panel 20, this springing action receiving the violent impact of the bullet, absorbing the shock and thus repelling the bullet penetration therethrough. It is to be noted that due to the outside panel 19 being wider than the inner panel 20, the outer panels of adjacent rows thereof overlap each other so that there is no possibility of bullets penetrating between the side edges thereof.

In FIG. 8, a modified design of element 27 is of N-shape so to incorporate outside panels 28 and 29 that are springy in respect to a central panel 30 that incorporates the tongues 14 and 15.

While various changes may be made in the detail construction, it is understood that such change will be within the spirit and scope of the present invention as is defined by the appended claims.

What I claim is:

1. An armored layer adapted to be used in a bullet proof garment, said armored layer comprising a plurality of metallic plates assembled in parallel rows, said plates being aligned both vertically and horizontally in said rows, each of said plates comprising an inner panel and an outer panel, said panels being joined by a U-bend, with the outer panel overlying, but being spaced from, said inner panel, each of said U-bends being at one end of said plate, with the other end of said plate being open, with the end of the outer panel being spaced from the adjacent end of the inner panel, and with a pair of adjacent upper and lower plates being nested together, with the U-bend of one being received in the open end of the other, means pivotally linking each pair of adjacent plates in a given row, and means pivotally linking each vertically aligned pair of plates in adjacent rows, whereby the outer panel of a plate serves a spring function that receives the violent impact of a bullet, thereby absorbing the shock and repelling the bullet penetration.

2. The armored layer of claim 1 wherein each outer panel is wider than its inner panel, whereby there is an overlap between adjacent plates, with the outer panel of one plate overlying the outer panel of the adjacent plate.

3. The armored layer of claim 1 wherein each of said inner panels has a first pair of hooks formed thereon, with one of said hooks being adjacent one of the edges of said inner panel and the other of said hooks being adjacent the other edge of said inner panel, said horizontally aligned plates being pivotally secured to each other by a clip secured to a pair of hooks of adjacent plates.

4. The armored layer of claim 3 and further including a second pair of hooks formed on said inner panels, said second pair of hooks being positioned at the lower edge of said inner panel, said second pair of hooks engaging the inner panel of the next lower plate in said armored layer, thereby pivotally securing said upper plate to the next lower plate.

* * * * *